US005661471A

United States Patent [19]

Kotlicki

[11] Patent Number: 5,661,471

[45] Date of Patent: Aug. 26, 1997

[54] EMERGENCY ALERT SYSTEM FOR A PROTECTED REGION EMPLOYING RF AND NON-RF SIGNALLING

[75] Inventor: Yaacov Kotlicki, Ramat Gan, Israel

[73] Assignees: VISONIC LTD.; MOTOCOM LTD., both of Tel Aviv, Israel

[21] Appl. No.: 400,586

[22] Filed: Mar. 8, 1995

[30] Foreign Application Priority Data

Nov. 7, 1994 [IE] Ireland ..... 111550

[51] Int. Cl.[6] ..... G08B 1/08

[52] U.S. Cl. ..... 340/825.37; 340/531; 340/539; 340/825.36; 340/825.49

[58] Field of Search ..... 340/531, 536, 340/539, 825.54, 825.36, 825.37, 825.49, 825.72; 455/9, 11

[56] References Cited

U.S. PATENT DOCUMENTS

| | | | |
|---|---|---|---|
| 4,225,953 | 9/1980 | Simon et al. | 367/117 |
| 4,275,385 | 6/1981 | White | 340/825.49 |
| 4,347,501 | 8/1982 | Akerberg | 340/539 |
| 4,611,198 | 9/1986 | Levinson et al. | 340/539 |
| 4,630,035 | 12/1986 | Stahl et al. | 340/539 |
| 4,837,568 | 6/1989 | Snaper | 340/825.49 X |
| 4,904,993 | 2/1990 | Sato | 340/825.72 X |
| 5,153,584 | 10/1992 | Engira | 340/825.49 X |
| 5,257,007 | 10/1993 | Steil et al. | 340/539 |
| 5,365,217 | 11/1994 | Toner | 340/539 |
| 5,467,074 | 11/1995 | Pedtke | 340/539 |
| 5,528,232 | 6/1996 | Verma et al. | 340/825.49 X |

FOREIGN PATENT DOCUMENTS

| | | | |
|---|---|---|---|
| 2-229-302 A | 9/1990 | United Kingdom | 340/825.49 |

OTHER PUBLICATIONS

Newspaper article, "Nurses Protected". (Aug. 3, 1995).
Pamphlet of Static System Group (Apr. 1994).

*Primary Examiner*—Michael Horabik
*Assistant Examiner*—William H. Wilson, Jr.
*Attorney, Agent, or Firm*—Nixon & Vanderhye P.C.

[57] ABSTRACT

A signaling network system including a plurality of receivers distributed in a protected region comprising multiple protected enclosures and including RF receivers as well as a plurality of non-RF receivers, located within said multiple protected enclosures, for receiving non-RF signals emanating from within the enclosure within which the receiver is located, said non-RF signals generally not capable of being received by a receiver located outside the enclosure from which they are transmitted and at least one portable emergency indicating signal transmitter which is selectably locatable in an enclosure and which is operative to transmit, when actuated, both RF and non-RF signals.

17 Claims, 5 Drawing Sheets

EMERGENCY ALERT SYSTEM FOR A PROTECTED REGION EMPLOYING RF AND NON-RF SIGNALLING

FIELD OF THE INVENTION

The present invention relates to signaling networks generally and more particularly to signaling networks employed in emergency alarm systems.

BACKGROUND OF THE INVENTION

Various types of signaling networks are known in the art. The present applicant/assignee currently markets a system known under the trademark SPIDERALERT, which provides personal alert services within a protected region, such as, for example for students and staff on university campuses, employees in a corporate facility, medical staff and patients, correctional officers, and users of large parking lots and garages. Once activated by a user, the SPIDERALERT system indicates both the identity and the location of the person requesting assistance.

The SPIDERALERT system is normally based on a user-actuable portable RF transmitter providing a user-identifying signal which is sensed by one or more RF receivers distributed throughout the protected region.

It has been found that when the protected region comprises a multiplicity of closely spaced together, individually walled-off sub-regions, such as hospital rooms or offices, each of which contains a receiver, it is often difficult to pinpoint the individual sub-region from which the alarm signal is being transmitted, due to the fact that RF signals readily pass through most interior partitions in a building and are detected by more than one RF receiver. Failure to pinpoint the individual room from which an alarm signal is being transmitted, could cause inconvenience and possibly critical delay in emergency situations.

U.S. Pat. No. 4,630,035 to Motorola, Inc. describes an alarm system having alarm transmitter identification codes and acoustic ranging. The location of an alarm is determined by sensing the time of arrival of two different signals and further requires that one signal have a propagation speed through air which is substantially different from that of the other signal.

U.S. Pat. No. 4,347,501 to Ericsson describes an installation for transmitting alarm signals wherein portable alarm devices transmit a coded message which includes coded information as to the location of the portable alarm device. This code is supplied to the portable alarm devices by local fixed transmitters located in each area.

SUMMARY OF THE INVENTION

The present invention seeks to provide an improved signaling network, which overcomes limitations in the prior art.

There is thus provided in accordance with a preferred embodiment of the present invention a signaling network system including:

a plurality of receivers distributed in a protected region including multiple enclosures and including receivers for RF transmitter identity information bearing signals as well as receivers for non-RF signals emanating from inside an enclosure in which a receiver is located; and at least one portable emergency indicating signal transmitter which is selectably locatable in the multiple enclosures and which is operative to transmit, when actuated, both RF transmitter identity information bearing signals and non-RF signals.

Preferably, the system also includes a control unit which receives outputs from the receivers and provides a sensible output indication of the location and identity of an actuated transmitter, specifying in which of the enclosures, the transmitter is located.

Preferably, the identity of the actuated transmitter is determined based on information contained in an RF transmission and the precise location of the actuated transmitter is determined based on the location at which the non-RF transmission is received.

Further in accordance with a preferred embodiment of the present invention there is provided a signaling method including:

distributing a plurality of receivers in a protected region including multiple enclosures and including receivers for RF transmitter identity information bearing signals as well as receivers for non-RF signals emanating from inside an enclosure in which a receiver is located; and actuating one of a multiplicity of portable emergency indicating signal transmitters which are selectably locatable in the multiple enclosures and causing it to transmit both RF transmitter identity information bearing signals and non-RF signals.

Preferably, the non-RF signals do not carry transmitter identity information. Alternatively, both signals may carry transmitter identity information.

Preferably, the method also includes receiving outputs from the receivers and providing, based thereon, a sensible output indication of the location and identity of an actuated transmitter, specifying in which of the enclosures, the transmitter is located.

In accordance with a preferred embodiment of the present invention the non-RF signals are ultrasonic signals. Alternatively, the non-RF signals are infra-red signals or any other signals which are highly attenuated by enclosure walls.

BRIEF DESCRIPTION OF THE DRAWINGS

The present invention will be understood and appreciated more fully from the following detailed description, taken in conjunction with the drawings in which.

DETAILED DESCRIPTION OF A PREFERRED EMBODIMENT

Figure 1:
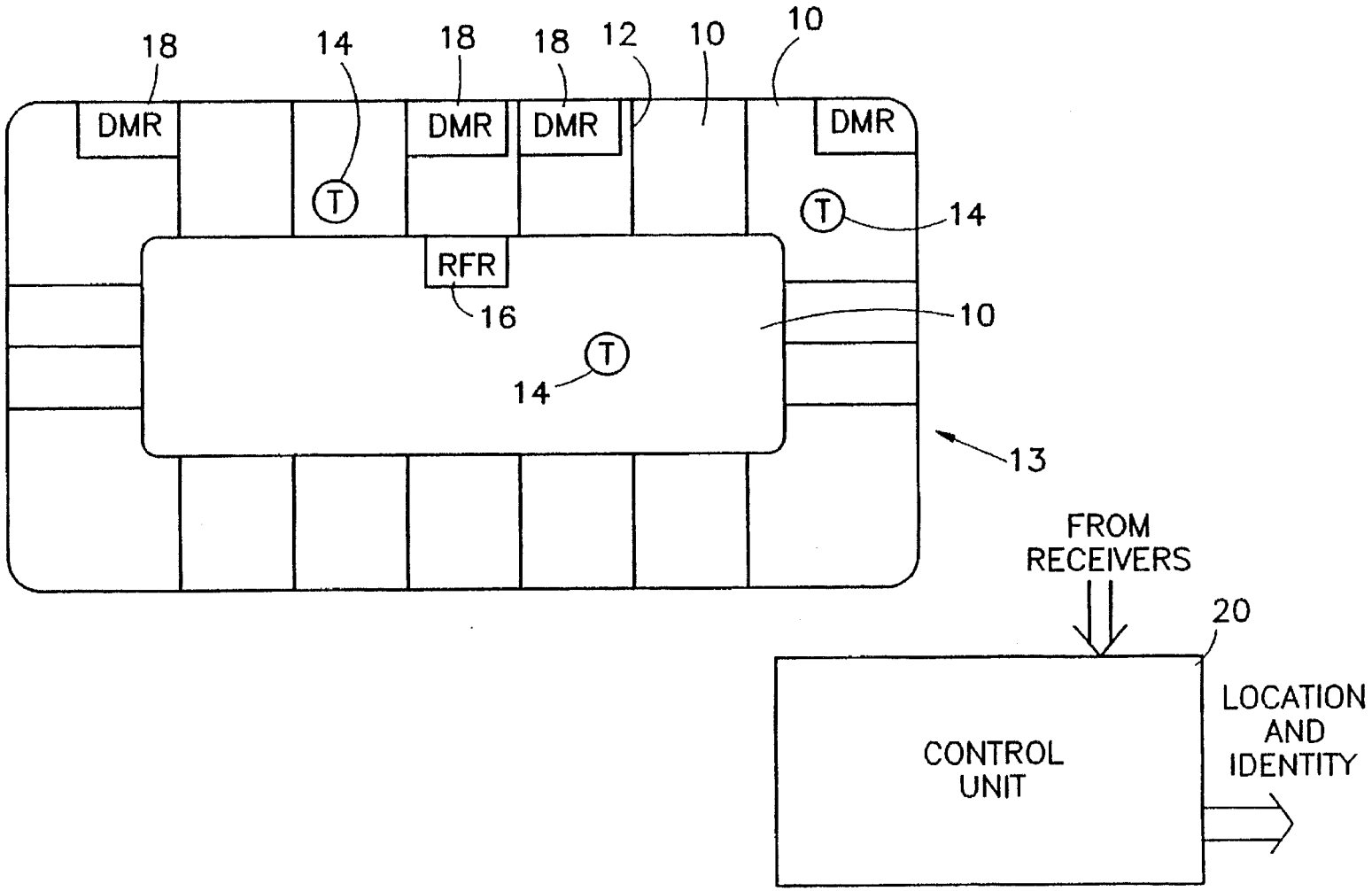
FIG. 1 is a simplified block diagram illustration of a signaling network system constructed and operative in accordance with a preferred embodiment of the present invention.

Reference is now made to FIG. 1 which illustrates a signaling network system constructed and operative in accordance with a preferred embodiment of the invention. The signaling network system is preferably operative in an environment, such as a hospital, prison or office comprising a plurality of enclosures 10, which are separated by walls 12. The plurality of enclosures is collectively referred to herein as a protected region 13.

In accordance with a preferred embodiment of the invention, a multiplicity of portable dual mode emergency indicating signal transmitters 14 are provided. A preferred embodiment of a transmitter 14 is described hereinbelow with reference to FIG. 2. The portable dual mode emergency indicating signal transmitters are normally suitable for being carried by persons in pockets, attached to a pendant or attached to their clothing and are selectably locatable in any of the multiple enclosures 10 and are operative to transmit, when actuated, both RF transmitter identity information bearing signals and non-RF signals.

In accordance with a preferred embodiment of the invention, the walls 12 of the enclosures are generally non-transmissive of the non-RF signals.

Figure 3:
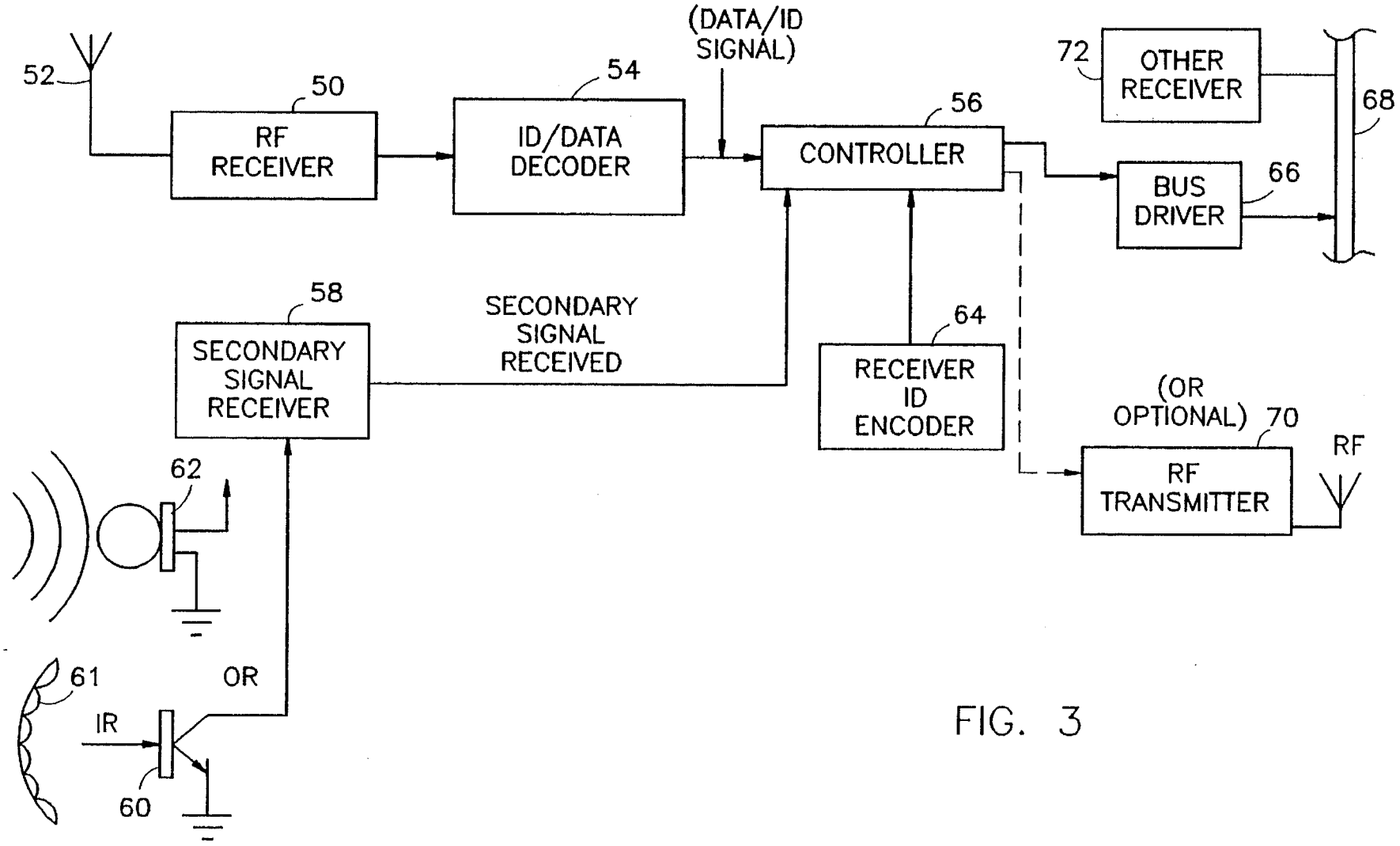
FIG. 3 is a simplified block diagram illustration of a dual mode receiver useful in the system of FIG. 1.

In accordance with one embodiment of the invention, at least one and preferably multiple RF receivers (RFR) 16 are located within the protected region 13. A non-RF signal receiver is preferably located within each enclosure 10. The RF and non-RF receivers may be combined in a dual mode receiver (DMR) 18, a preferred embodiment of which is shown in FIG. 3 and described hereinbelow. In accordance with a preferred embodiment of the invention, a dual mode RF, non-RF receiver 18 is located within each enclosure 10.

Figure 4:
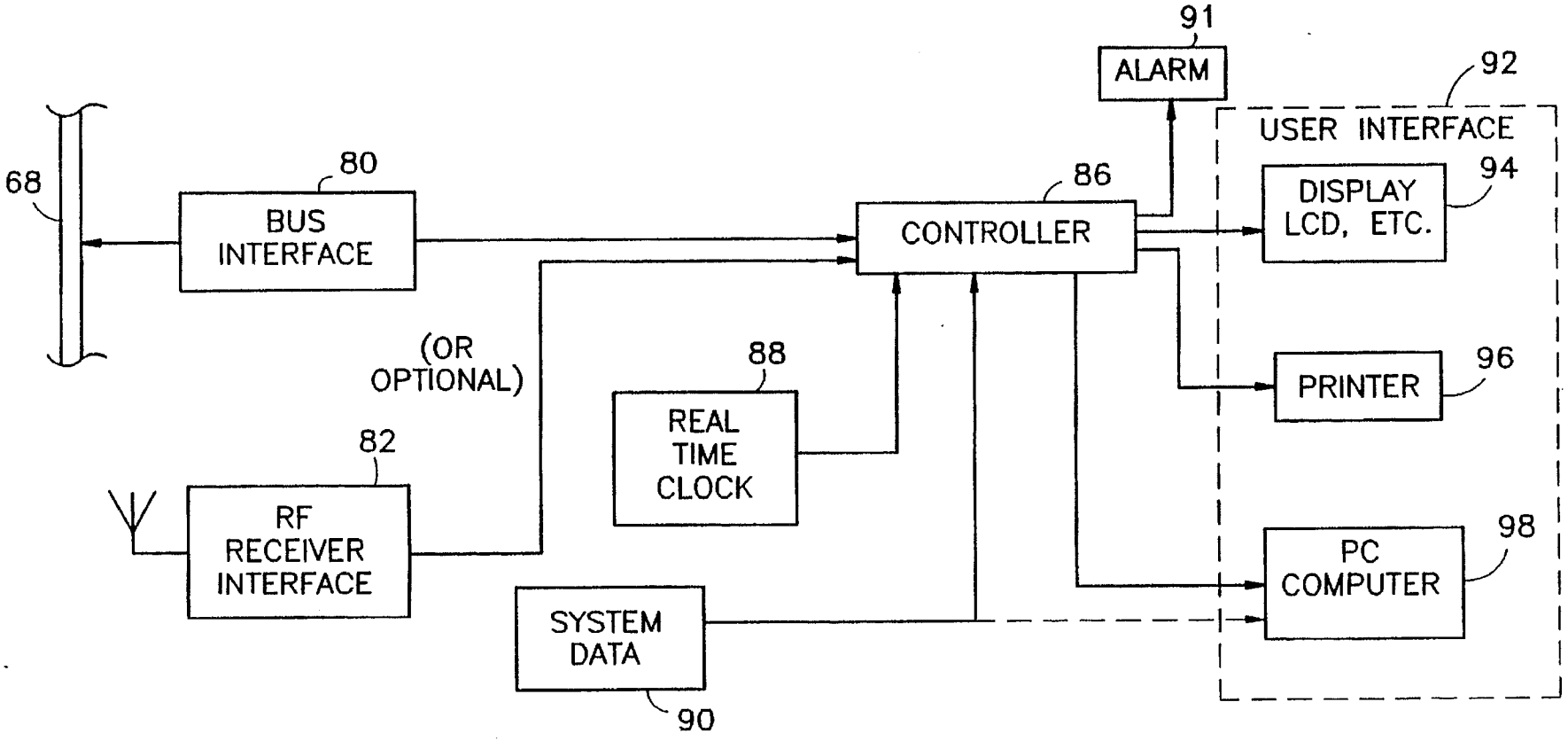
FIG. 4 is a simplified block diagram illustration of a control unit useful in the system of FIG. 1.
Figure 5:
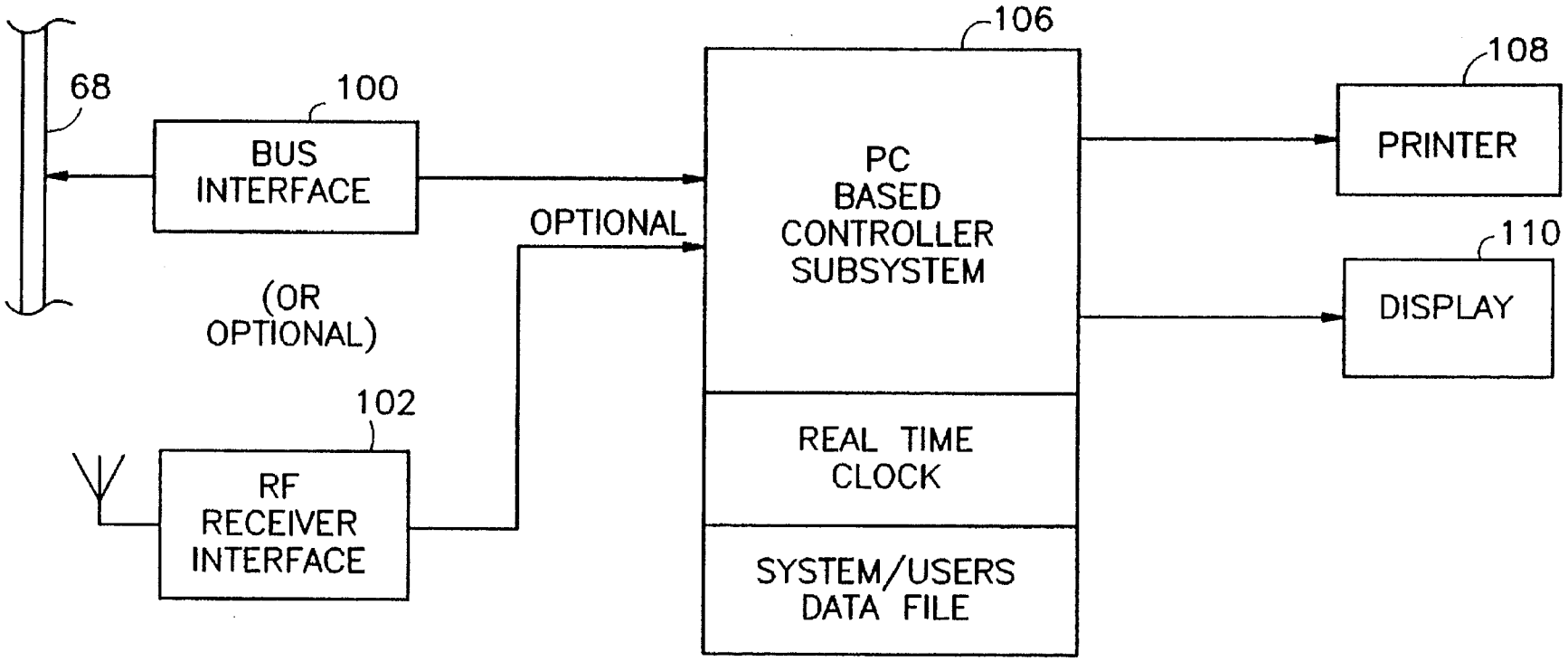
FIG. 5 is a simplified block diagram illustration of a PC-based control unit.

Dual mode receivers 18 are connected to a control unit 20 by wires, radio or any other suitable communications means (not shown). The control unit 20 is operative to provide an output indication of both the identity of the portable transmitter transmitting an emergency signal and the location, i.e. the individual enclosure in which the transmitter was located at the time of the transmission of the emergency signal. Preferred embodiments of control unit 20 are illustrated in FIGS. 4 and 5.

It is a particular feature of the present invention that the non-RF signals, which generally do not penetrate the boundaries of enclosures 10 are employed to provide information regarding the location of a transmitter transmitting an emergency signal, while the RF signals, which do penetrate the boundaries of enclosures 10, but have greater information carrying capability, are used for carrying information identifying the source of the emergency signal transmission.

Figure 2:
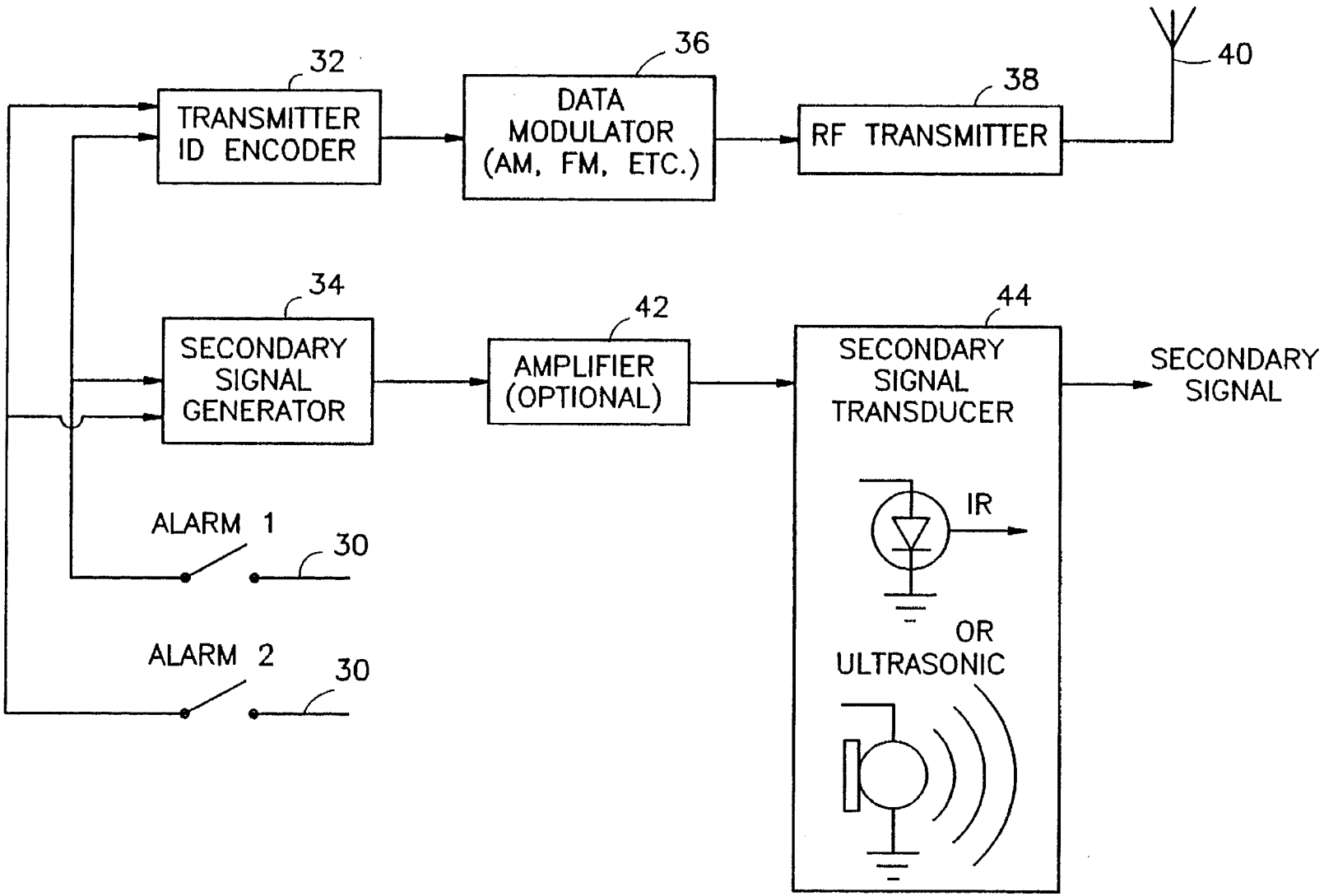
FIG. 2 is a simplified block diagram illustration of a dual mode transmitter useful in the system of FIG. 1.

Reference is now made to FIG. 2, which illustrates a dual-mode transmitter constructed and operative in accordance with a preferred embodiment of the present invention. The dual mode transmitter typically comprises one or more manually actuable switches 30 which provide actuation signals to a transmitter ID encoder 32 and to a secondary signal, e.g. non-RF, oscillator 34.

The transmitter ID encoder 32 transmits a predetermined code which identifies the individual transmitter to a data modulator 36, which may operate using AM, FM or any other modulation technique, and modulates a signal carrier. The modulated signal carrier is supplied to an RF transmitter 38 which transmits an emergency signal via an antenna 40.

The secondary signal generator 34 provides a non-RF signal, such as an IR or ultrasonic signal which generally does not propagate beyond a given enclosure, optionally via an amplifier 42, to a secondary signal transducer 44, such as an I.R. LED or ultrasonic transducer, which provides a secondary emergency signal, preferably an IR or ultrasonic signal which generally does not propagate beyond a given enclosure. Optionally, the secondary signal may be modulated to provide transmitter identity information.

It is appreciated that transmitter 14 may provide one or more different types of emergency messages, or alternatively one or more types of emergency message and one or more types of non-emergency message, such as a low battery indication or test signals.

Reference is now made to FIG. 3, which illustrates a dual mode receiver which is useful in the present invention.

The dual mode receiver comprises a conventional RF receiver 50 which receives RF signals via an antenna 52 and provides received demodulated signals to an Transmitter ID/Data decoder 54, which decodes the ID, emergency and non-emergency data references from the transmitter RF signal. The output of decoder 54 is preferably supplied to a controller 56, which also receives a secondary signal from a secondary signal receiver 58.

Secondary signal receiver 58 receives a secondary signal transmitted by transmitter 14, such as an IR signal or an ultrasonic signal, from a respective phototransducer 60, such as a phototransistor or photodiode, which may be provided with a radiation collection lens 61, or ultrasonic transducer 62.

Preferably, the radiation collection lens is a multi-segmented lens, such as, for example, Lens No. 51, which is commercially available from Visonic Ltd. of Tel Aviv, Israel. A multi-segmented lens is operative to collect IR radiation impinging thereon from various directions.

Controller 56 also receives an input from a receiver ID encoder 64, for identifying the receiver to the control unit 20 (FIG. 1). The controller 56, which may be a microprocessor, provides an output indicating the identity of the transmitter 14 and of the receiver (16 and/or 18) as well as an indication as to whether the dual mode receiver receives the secondary signal. The output may also include additional information relating to an emergency or non-emergency condition.

The output of controller 56 is supplied via a bus driver 66 to a bus 68 to which other receivers 72 are connected and which communicates with the control unit 20. Alternatively, the communication with control unit 20 may be wireless, via an RF link including an RF transmitter 70.

In accordance with an alternative embodiment of the invention, wherein single mode receivers, rather than dual mode receivers are employed, the single mode receiver will be similar to that described hereinabove with respect to FIG. 3, absent certain elements. More specifically, a single mode RF receiver will not include elements 58, 60, 61 and 62 described hereinabove. A single mode non-RF receiver will not include elements 50, 52 and 54. Where the non-RF receiver receives transmitter identity information, a decoder similar to decoder 54 is coupled to the output of receiver 58.

Reference is now made to FIG. 4, which illustrates a preferred embodiment of control unit 20 (FIG. 1). The control unit comprises a bus interface 80 and/or an RF receiver interface 82, which communicate with a plurality of dual mode receivers 18, which may include dual mode receivers of the type described hereinabove in connection with FIG. 3 or with single mode receivers. Interfaces 80 and/or 82 supply the output of controllers 56 of the various receivers, or their equivalent, to a controller 86. Controller 86, which is typically microprocessor based, may include a real-time clock 88 and a look-up-table 90 which contains system data including the identities of all of the transmitters and receivers in the system and the corresponding locations of all of the receivers.

In response to the received information from the receivers, the controller 86, using the system data in the look-up-table 90, may actuate an alarm 91 which may include visual and/or audio components and provides an emergency information output to a user interface 92, which may include one or more of the following elements: a display 94, a printer 96 and a PC computer 98. It may also include a map of the protected region in which the locations of the various enclosures to which the various receivers 18 correspond.

The controller 86 determines based on the inputs received from one or more receivers and the identification data from the look-up table 90, and particularly from receivers receiving the secondary transmission, the enclosure from which the emergency transmission was transmitted.

The user interface provides to an operator in real time, the location of the enclosure from which an emergency transmission was sent and identification of the authorized user of the transmitter 14, so as to enable emergency assistance to be directed precisely to the correct location.

Reference is now made to FIG. 5, which illustrates another preferred embodiment of control unit 20 (FIG. 1). The control unit comprises a bus interface 100 and/or an RF receiver interface 102, which communicate with a plurality of dual mode receivers 18, which may include dual mode receivers of the type described hereinabove in connection with FIG. 3 or with single mode receivers.

Interfaces 100 and/or 102 supply the output of controllers 56 of the various receivers, or their equivalent, to a PC based controller subsystem 106 which includes inter alia a real-time clock a system/users data file. Subsystem 106 typically outputs to a printer 108 and/or a display 110.

It will be appreciated by persons skilled in the art that the present invention is not limited to what has been particularly shown and described hereinabove. Rather the invention is intended to include also modifications and variations which are not known or obvious from the prior art. Accordingly, the present invention is defined only by the claims which follow.

I claim:

1. A signaling network system including:

a plurality of receivers distributed in a protected region comprising multiple protected enclosures and including RF receivers as well as a plurality of non-RF receivers, located within said multiple protected enclosures, for receiving non-RF signals emanating from within the enclosure within which the receiver is located, said non-RF signals generally not capable of being received by a receiver located outside the enclosure from which they are transmitted;

at least one portable emergency indicating signal transmitter which is selectably locatable in an enclosure and which is operative to transmit, when actuated, both RF and non-RF signals, said at least one portable emergency indicating signal transmitter being operative to transmit a transmitter identity information bearing signal; and a monitoring unit receiving information transmitted via both said RF and said non-RF signals for providing an alarm indication of transmitter identity and location in a given protected enclosure based on information received from both said RF and said non-RF signals.

2. A system according to claim 1 and wherein said RF signal comprises a transmitter identity information bearing signal.

3. A system according to claim 2 and wherein said non-RF signal does not comprise a transmitter identity information bearing signal.

4. A system according to claim 1 and wherein said non-RF signal comprises a transmitter identity information bearing signal.

5. A system according to claim 1 and wherein said enclosures are generally non-transmissive of said non-RF signals, such that reception of a non-RF signal by a receiver indicates that the non-RF signal emanates from within the enclosure in which the receiver is located.

6. A system according to claim 1 and wherein said non-RF signals are ultrasonic signals.

7. A system according to claim 1 and wherein said non-RF signals are infra-red signals.

8. A system according to claim 1 and wherein said monitoring unit is operative to provide an indication of the time of alarm occurrence.

9. A signaling method including:

distributing a first plurality of receivers in a protected region including multiple enclosures and including receivers for RF transmitter identity information bearing signals and non-RF signals which normally do not propagate outside of an enclosure;

actuating one of a multiplicity of portable emergency indicating signal transmitters which are selectably locatable in the multiple enclosures and causing it to transmit both RF transmitter identity information bearing signals and non-RF signals, whereby receipt by a receiver of a non-RF signal indicates generally that the transmitter of said non-RF signal is within the same enclosure as the receiver; and providing an alarm indication of transmitter identity and location in a given protected enclosure based on information received from both said RF and said non-RF signals.

10. A method according to claim 9 and wherein said non-RF signals are ultrasonic signals.

11. A method according to claim 9 and wherein said non-RF signals are infra-red signals.

12. A method according to claim 9 and wherein said non-RF signals are signals which are highly attenuated by enclosure walls.

13. A method according to claim 9 and also comprising providing an indication of the time of alarm occurrence.

14. An emergency signaling network system for detecting an emergency condition within a protected area including multiple enclosures, the system comprising:

at least one portable emergency indicating signal transmitter which is operative to transmit, when actuated, both RF and non-RF signals, said RF including transmitter identity information, said non-RF signal being highly attenuated by walls of said multiple enclosures; and a plurality of receivers including at least one RF receiver for receiving said RF signals and plural non-RF receiver elements for receiving said non-RF signals, individual ones of said plurality of non-RF receivers being located within individual ones of said multiple enclosures and each being assigned an individual receiver identity code corresponding to the enclosure in which it is located; and a central unit operative to receive information from at least one RF receiver and at least one non-RF receiver and for providing, based on said transmitter identity information from said at least one RF receiver and at least one non-RF receiver and said individual receiver identity codes, an output indication of the identity and location of the actuated transmitter.

15. A system according to claim 14 and wherein at least some of said plurality of receivers comprises dual mode receivers including both an RF receiver and a non-RF receiver.

16. A system according to claim 15 and wherein in each dual mode receiver the RF receiver also is assigned an identity code which is identical to that of the non-RF receiver forming part of the same dual mode receiver.

17. A system according to claim 14 and wherein said central unit is operative to provide an indication of the time of alarm occurrence.

* * * * *

UNITED STATES PATENT AND TRADEMARK OFFICE

CERTIFICATE OF CORRECTION

PATENT NO. : 5,661,471
DATED : August 26, 1997
INVENTOR(S) : Yaacov Kotlicki et al.

It is certified that error appears in the above-identified patent and that said Letters Patent is hereby corrected as shown below:

Title page,
Item [30], Foreign Application Priority Data, please delete "[IE] Ireland" and insert -- [IL] Israel --

Signed and Sealed this

Eighth Day of March, 2005

JON W. DUDAS
*Director of the United States Patent and Trademark Office*